US010392909B2

(12) United States Patent
Lohr, Sr.

(10) Patent No.: US 10,392,909 B2
(45) Date of Patent: Aug. 27, 2019

(54) NONEXPLOSIVE DEVICE FOR PERFORATING WELL CASING AND FRACKING

(71) Applicant: ADVANCED HYDROGEN POWER TECHNOLOGIES, LLC, Lenoir, NC (US)

(72) Inventor: Peter James Lohr, Sr., Lenoir, NC (US)

(73) Assignee: Advanced Hydrogen Technologies Corporation (AHTC), Morganton, NC (US)

( * ) Notice: Subject to any disclaimer, the term of this patent is extended or adjusted under 35 U.S.C. 154(b) by 251 days.

(21) Appl. No.: 15/131,941

(22) Filed: Apr. 18, 2016

(65) Prior Publication Data

US 2017/0089184 A1 Mar. 30, 2017

Related U.S. Application Data

(60) Provisional application No. 62/148,552, filed on Apr. 16, 2015.

(51) Int. Cl.

| | |
|---|---|
| ***E21B 43/11*** | (2006.01) |
| ***E21B 43/116*** | (2006.01) |
| ***E21B 43/26*** | (2006.01) |

(52) U.S. Cl.

CPC ..... *E21B 43/11* (2013.01); *E21B 43/116* (2013.01); *E21B 43/26* (2013.01)

(58) Field of Classification Search

CPC ..... E21B 43/11; E21B 43/112

See application file for complete search history.

(56) References Cited

U.S. PATENT DOCUMENTS

| | | | | |
|---|---|---|---|---|
| 2,530,805 A * | 11/1950 | Bond | E21B 43/116 124/59 |
| 2,593,620 A | 4/1952 | Spencer | |
| 2,884,836 A * | 5/1959 | Allen | E21B 43/116 102/499 |
| 2,953,971 A * | 9/1960 | Porter | E21B 43/116 102/434 |
| 3,075,462 A * | 1/1963 | Adamson, Jr. | E21B 43/116 102/306 |

(Continued)

FOREIGN PATENT DOCUMENTS

| | | |
|---|---|---|
| RU | 2403380 | 11/2010 |
| SU | 1596082 | 9/1990 |

OTHER PUBLICATIONS

Ledneva, T., International Search Report for PCT/US2016/028136,dated Aug. 25, 2016, Moscow, Russia.

*Primary Examiner* — Robert E Fuller

(74) *Attorney, Agent, or Firm* — Trego, Hines & Ladenheim, PLLC

(57) ABSTRACT

A device for perforating a well-casing. The device includes a body that has a passageway defined in it. The passageway has a first portion and a second portion. The body is configured to transition from a first condition to a second condition. When the body is in the first condition, the first portion of the passageway is not fluidly connected to the second portion passageway. When the body is in the second condition, the first portion of the passageway is fluidly connected via the second portion of the passageway to an exterior surface of the well casing.

9 Claims, 8 Drawing Sheets

(56) References Cited

U.S. PATENT DOCUMENTS

| | | | | | |
|---|---|---|---|---|---|
| 3,209,650 | A * | 10/1965 | Andrew | E21B 43/116 | 102/320 |
| 3,430,711 | A * | 3/1969 | Taggart | E21B 43/10 | 166/100 |
| 3,502,161 | A | 3/1970 | Coman | | |
| 5,425,424 | A * | 6/1995 | Reinhardt | E21B 33/16 | 166/291 |
| 5,765,637 | A * | 6/1998 | Dietle | E21B 33/13 | 166/100 |
| 6,457,528 | B1 * | 10/2002 | Staudt | E21B 17/08 | 166/335 |
| 2007/0017675 | A1 * | 1/2007 | Hammami | E21B 33/13 | 166/278 |

* cited by examiner

NONEXPLOSIVE DEVICE FOR PERFORATING WELL CASING AND FRACKING

BACKGROUND OF THE INVENTION

This invention relates generally to devices for perforating well casings and more specifically to a device for perforating well casings and fracturing rock as part of the hydraulic fracturing, or fracking, method of drilling for petroleum resources.

High explosive perforation guns are the conventional method of explosively perforating wellbores. In a well that has been cased and otherwise completed before stimulation, perforation devices ("perforating guns") containing carefully placed high explosive charges are sent downhole, typically with wirelines, and detonated using electrical signals in order to create a flow of oil/gas into the wellbore.

There are several problems with the conventional methods that are used for perforating a wellbore. One problem is that there is a high potential for accidents caused by explosives used for perforations.

Another problem is delays associated with removing the perforating device before utilizing the well.

Another problem is the inability of the conventional methods to penetrate rock satisfactorily to provide a pathway for ground resources.

Another problem is insufficient fracturing occurring during the perforation step.

Another problem is the compaction of rock caused by the detonation wave associated with high explosives.

Accordingly, there remains a need for a device that is configured to perforate a well casing and to fracture surrounding rock such that ground resources can be extracted.

BRIEF SUMMARY OF THE INVENTION

This need is addressed by the present invention, which provides a device configured to perforate a well casing using projectiles and to fracture rock that surrounds well casing with the same projectiles that were used to perforate the well casing.

According to one aspect of the invention, there is provided a device for perforating a well casing. The device includes a body that has a passageway defined in it. The passageway has a first portion and a second portion. The body is configured to transition from a first condition to a second condition. When the body is in the first condition, the first portion of the passageway is not fluidly connected to the second portion of the passageway. When the body is in the second condition, the first portion of the passageway is fluidly connected via the second portion of the passageway to an exterior surface of the well casing.

According to another aspect of the invention, there is provided an apparatus for perforating a well casing. The apparatus includes a body that has a cavity defined in it. The cavity is fluidly connected to at least one pressure path that is defined in the body. A seal is positioned in the pressure path until the seal is exposed to a predetermined pressure differential. A barrel is positioned such that it can be fluidly connected to the pressure path and a projectile is positioned in the barrel. The barrel is blocked at an end opposite the projectile and the blockage is configured to be ruptured by the projectile.

According to another aspect of the invention, there is provided a method for perforating a well casing and preparing a well for extraction of fluids from rock positioned near the well. The method includes the steps of: positioning a device within a well casing, the device including a passageway having a projectile positioned therein; blocking the passageway with a seal; exposing a portion of the passageway to a high pressure fluid; causing the seal to fail due to the pressure of the high pressure fluid within the portion of the passageway; expelling the projectile from the passageway; puncturing the well casing with the projectile such that openings are formed therein; and clearing the passageway.

BRIEF DESCRIPTION OF THE DRAWINGS

The invention may be best understood by reference to the following description taken in conjunction with the accompanying drawing figures, in which.

DETAILED DESCRIPTION OF THE INVENTION

Figure 1:
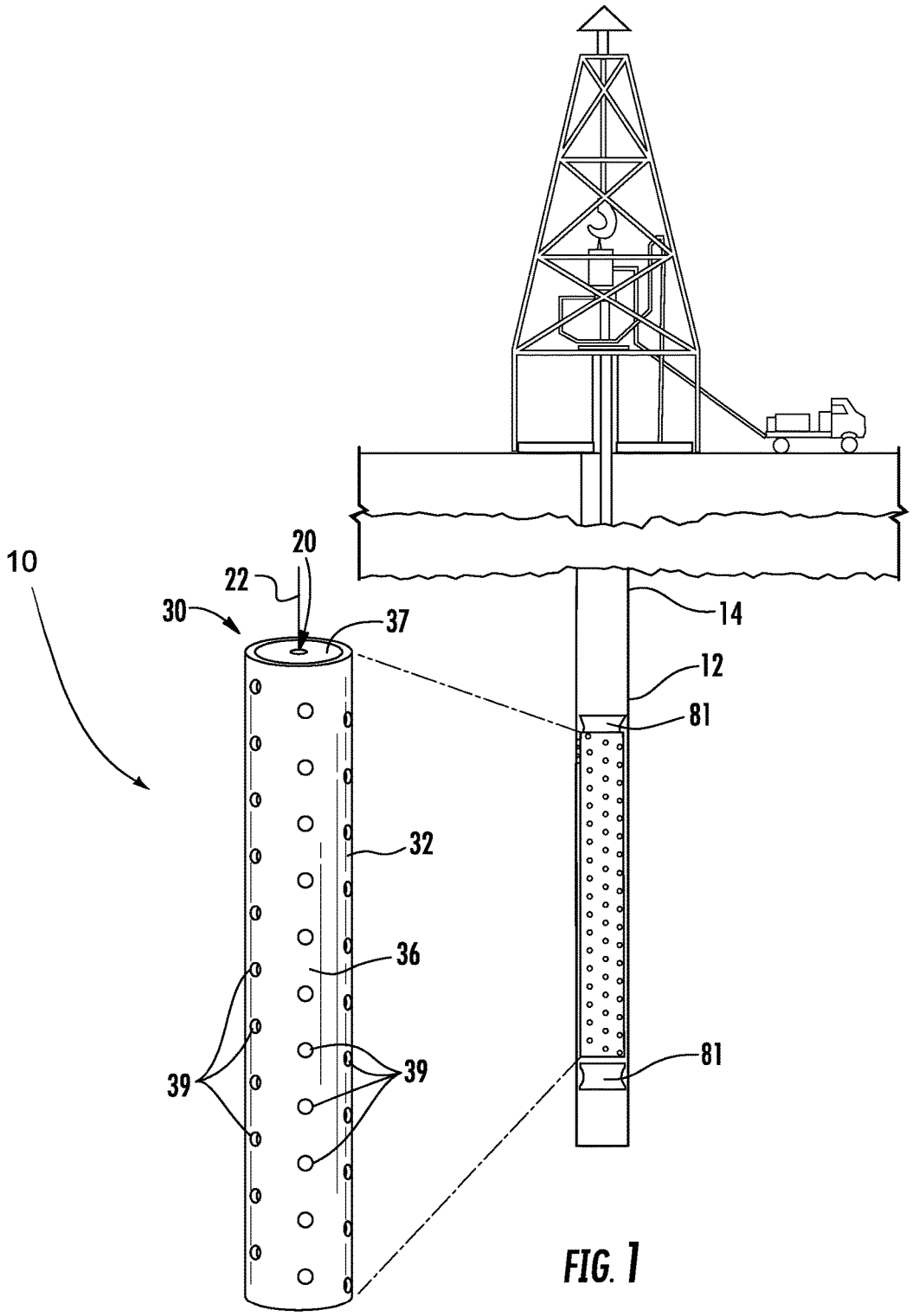
FIG. 1 is a schematic view of a device positioned in a well casing.

Referring to the drawings wherein identical reference numerals denote the same elements throughout the various views, FIG. 1 illustrates a well casing perforation device 10. The device 10 is configured to perforate a well casing 12 of a well 14. The device 10 is configured to utilize a nonexplosive source of ultra-high pressure fluid to launch and expel projectiles through the outer surface of the device 10 and through the well casing, and into the surrounding rock to form fractures. According to the illustrated embodiment, the device uses a source of high pressure hydrogen gas. One such source is a cartridge 20. A suitable cartridge 20 is the cartridge described in U.S. Pat. No. 7,967,879 entitled CARTRIDGE FOR THE GENERATION OF HYDROGEN to Lohr. The device 10 is configured such that the ultrahigh or high pressure blast of fluid such as hydrogen gas that further increases the depth of the rock fractures as the fluid follows a projectile. The device 10 is configured such that it is in a first condition prior to initiation of the cartridge 20 and in a second condition after initiation of the cartridge 20.

Figure 2:
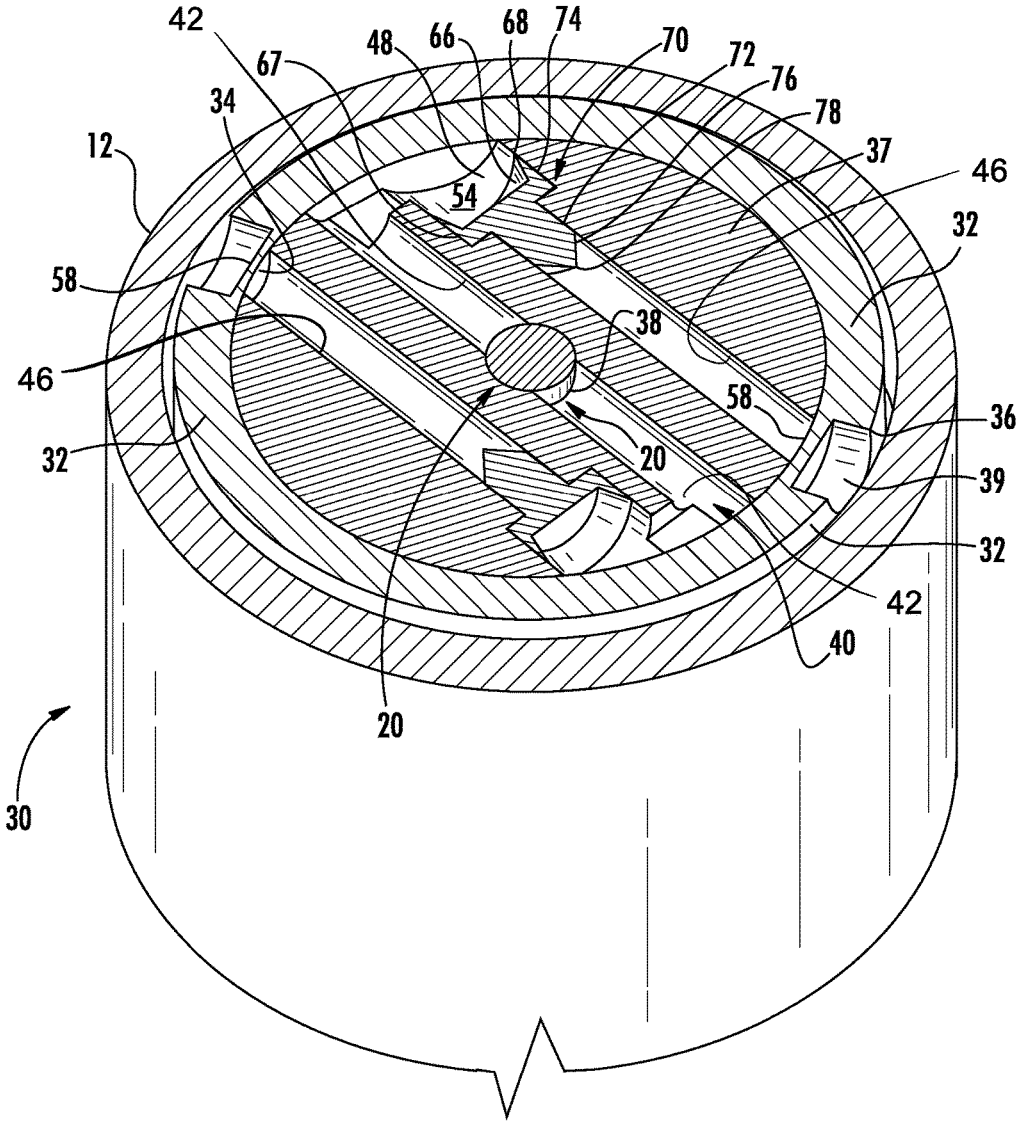
FIG. 2 is a perspective view of a section of a device.
Figure 3A:
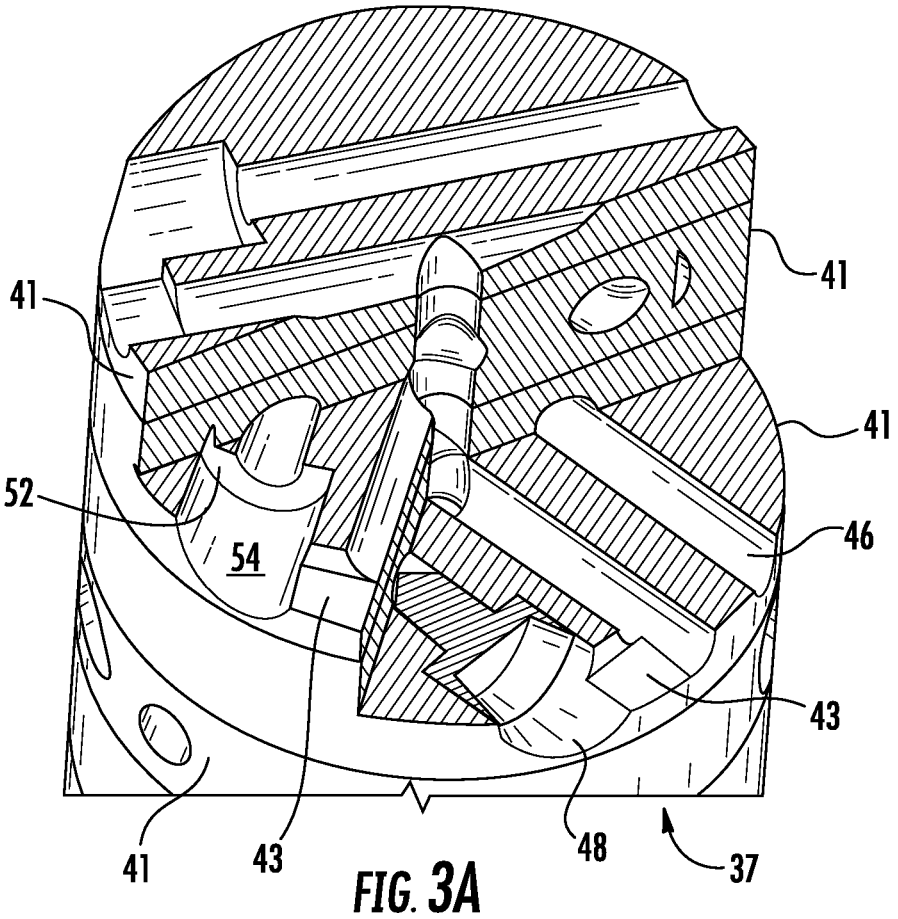
FIG. 3A is a partially cutaway view of a section of a portion of the device.
Figure 3B:
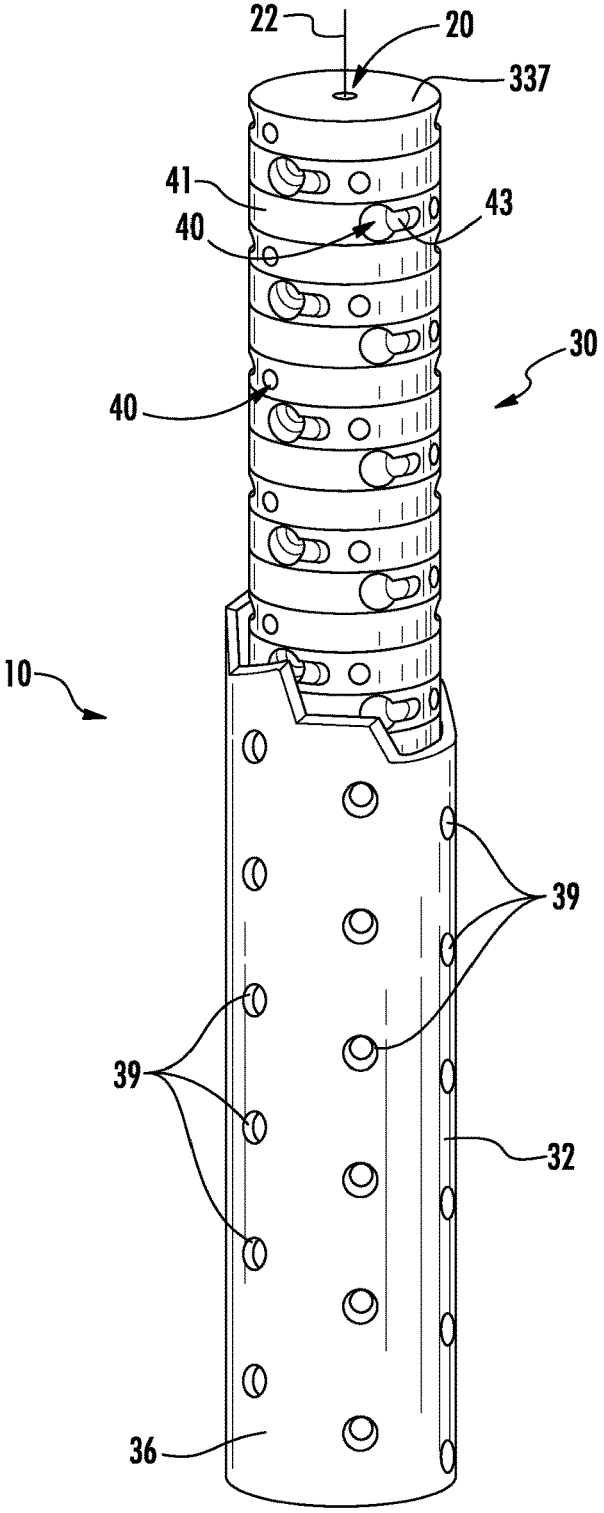
FIG. 3B is a partially cutaway view of the device.
Figure 4:
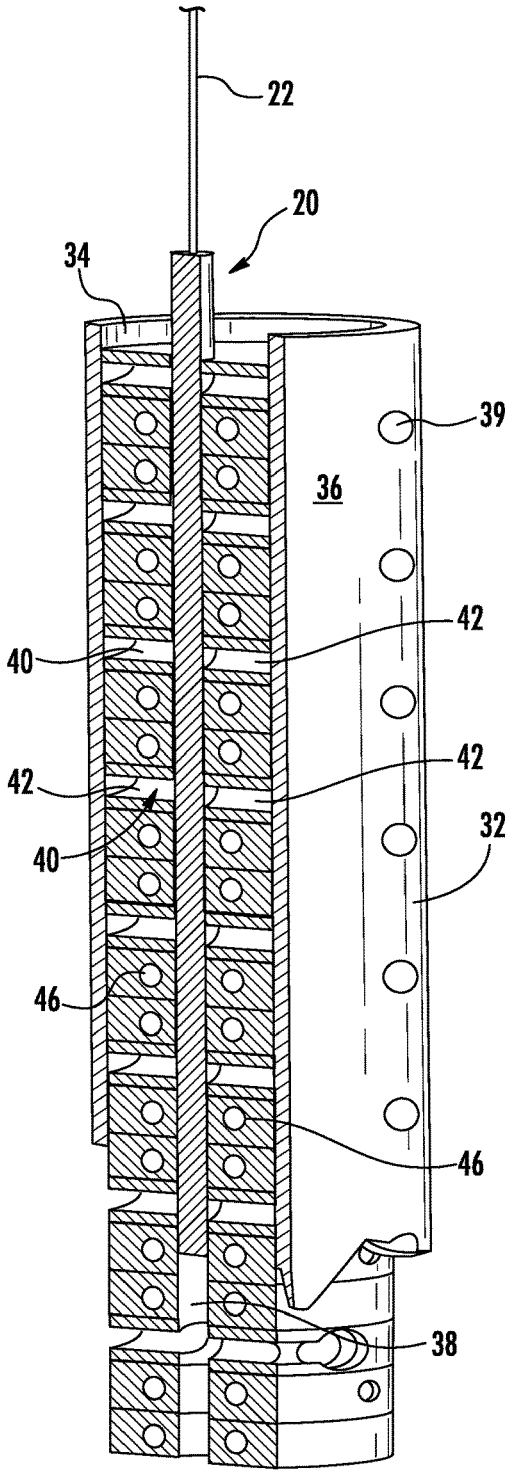
FIG. 4 is a perspective of a sectional view of a portion of a device.

Referring now to FIGS. 2-4, the device 10 includes a body 30. According to the illustrated embodiment, the body 30 is generally cylindrical. It should be appreciated that the body 30 is configured to fit within the well casing 12 of the well 14. The body 30 includes a housing 32 and the housing 32 defines an interior wall surface 34 and an exterior wall surface 36. The housing 32 is configured to receive a core 37. In some embodiments the device 10 does not include a housing 32 that is separate from the core 37. It should be appreciated that the exterior features of the housing 32 is defined in these embodiments on an exterior of the core 37.

The core 37 defines a fuel rail 38. The fuel rail 38 is a cavity that extends at least partially through the core 37. In some embodiments there are multiple rails and cartridges 20 within the multiple rails can be configured to discharge substantially simultaneously or in a predetermined pattern. The fuel rail 38 is configured to receive the cartridge 20 such that the cartridge 20 is in electrical communication with an ignition controller (not shown). The ignition controller is configured to initiate cartridge 20 such that a chemical reaction begins that creates high pressure hydrogen. According to the illustrated embodiment, the cartridge 20 is electrically connected to an ignition controller by ignition wire 22. It should be appreciated that the cartridge 20 could be electrically connected to an ignition controller wirelessly through electromagnetic wave such as radio waves, sonically, or the like.

A plurality of passageways 40 are fluidly connected to the fuel rail 38. The passageways 40 are arranged in layers 41. It should be appreciated that the plurality of passageways 40 can be arranged such they are not in layers. According to the illustrated embodiment there are two passageways 40 in each layer 41. In other embodiments the passageways 40 can be arranged in many different geometrical configurations. They can be spiral, diagonally positioned relative to the sides of the core 37 or other configuration. In the illustrated embodiment each layer 41 is defined by a wafer such that each layer 41 can be manufactured separately and then stacked together and inserted into the housing 32 to form the core 37.

Referring now to FIG. 2, each passageway 40 includes a first portion 42 that is fluidly connected to the fuel rail 38. Each passageway 40 also includes a receiver 48 that is fluidly connected to the first portion 42 via a connector 43. The receiver 48 is generally cup-shaped and defines a receiver wall 54 that extends away from a shoulder 52 toward the connector 43. A second portion 46 of the passageway 40, or barrel, extends away from the connector 43 toward an end barrier 58.

As shown in FIG. 2, the end barrier 58 is defined by an interior wall surface 34 of the housing 32. In the illustrated embodiment, the end barrier 58 is a breakout section defined by a pit 39 that is defined on the exterior surface 36 of the housing 32. In this regard, the barrier 58 is essentially a thin region in the housing 32. In some embodiments, the barrier 58 is about or substantially equal to the thickness of the housing 32. The end barrier 58 is configured to protect the device 10 from high pressures that might occur within a well 14 depending upon the depth at which the device 10 is placed. The second portion 46 and the end barrier 58 can be arranged such that they are evenly distributed along the length of the device 10 and about its circumference. In alternative embodiments, they can be distributed in a predetermined pattern such as one configured to discharge projectiles from only one side of the device are arranged such that they are oriented down well to further extend the well or remove blockages therein.

FIG. 2 shows the device 10 in a first condition prior to the ignition of the cartridge 20. In the first condition, a slug 70 is positioned within each passageway 40 between the first portion 42 and the second portion 46. The slug 70 includes a projectile portion 72 that extends to an end 76 which has a tip 78 defined thereon. The projectile portion 72 can have an end 76 which is configured to be blunt or of some other geometric shape.

The slug 70 also includes a flange 74 that extends away from the projectile portion 72. The flange 74 is configured to be positioned in the receiver 48 such that the flange 74 engages the shoulder 52 of the receiver 48. A tapering wall 67 extends away from the flange 74 to a rim 68 to define a cup 66. The cup 66 defines a sealing surface 69 that is configured to sealingly engage the receiver wall 54. The slug 70 is dimensioned to fluidly separate the first portion 42 and the second portion 46 of the passageway 40. It should be appreciated that in other embodiments, in the first condition of the device 10, the projectile 72 is not attached to a flange 74. In these embodiments, the projectile 72 is separate from a seal or barrier that is configured to sealingly engage the receiver wall 54 such that the barrier is operable to fluidly separate the first portion 42 from the second portion 46 sufficiently to generate between pressure differentials required as described further in the description of the operation below.

In the illustrated embodiment, bladders 81 can be positioned at either end of the device 10 and inflated such that gases generated by discharge of the cartridge 20 are contained in a predetermined area such that a predetermined pressure is reached and transformation of the device 10 from the its first condition to at second condition is achieved.

The device 10 is preferably formed of steel. By way of example and not limitation, the device 10 can be formed of one of the following: metals, polymer and fiber composites, ceramic and fiber composites, polymers, ceramics, and a combination thereof. It should be appreciated that device 10 can be manufactured by machining the wafers 41 and stacking them to form the core 37. The core 37 can then be inserted into the housing 32 to form the body 30. Other methods of manufacture can also be appropriate. For example, 3-D printing in which the body 30 in a manner such that the housing 32 is a contiguous part of the core 37. Also, another example of manufacture for the core 37 could be casting or machining from a billet.

The present invention can be better understood by description of the operation thereof. The device 10 is lowered into a well such that it is positioned within a well casing. The device 10, as it is in the first condition, is then operated by the following method to transition to the second condition. It should be appreciated that the device in the second condition is configured to allow for the flow of ground resources from the outside of the well casing through the passageways 40, into the fuel rail 38, out of the device 10, and into the well casing 22 through which it is ultimately drawn from the well 14.

The method is as follows: A) filling a portion of the passageway with a high pressure fluid; B) expelling the projectile from the passageway; C) puncturing the well casing with the projectile such that openings are formed therein; D) clearing the passageway; E) expelling the projectile 70 into rock or other ground material positioned near the well casing; F) creating pathways in the rock with the projectile; and G) expelling the high pressure fluid into the pathways in the rock such that the rock is further fractured.

Figure 5:
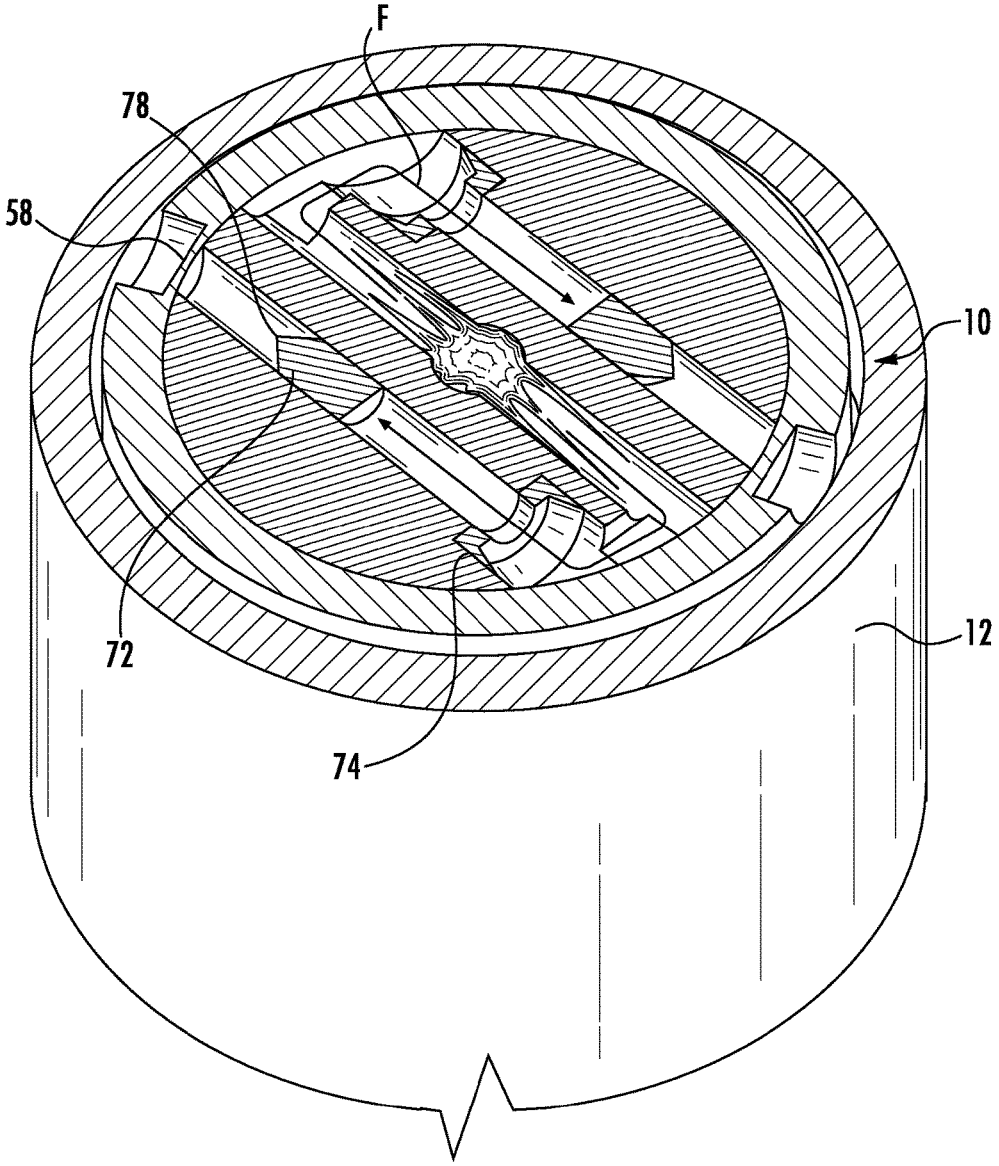
FIG. 5 is a perspective view of a section of the device during operation of the present invention in which the device transitions from a first condition to a second condition.

Referring now to the step A) indicated above, the operation of the cartridge 20 causes high pressure high temperature hydrogen to fill the first section 42 of the passageway 40. This causes a pressure differential to be created between the first section 42 of the passageway 40 and the second section 46 of the passageway 40. In particular the pressure within the receiver 48 relative to the second section 46 increases such that the flange 74 fails and separates from the projectile 72 of the slug 70. As can be seen in FIG. 5, gas generated from the cartridge 20 leaves the fuel rail 38 and flows along the path F to propel projectiles 72 such that tip 78 pierces end barrier 58 and barrier 58 is opened and the well casing 12 is pierced as the projectile 72 passes therethrough. The projectile 72 then accelerates down the second portion 46 of the passageway 40. In this regard the second portion 46 of the passageway 40 operates as a barrel and high pressure hydrogen generated by cartridge 20 follows flow path F as seen in FIG. 5. Preferably, the second portion 46 of the passageway 40 is as long as possible as allowed by the dimensions of the well casing 12 and the device 10 such that maximum acceleration of the projectile 72 is achieved.

Referring to step D) the device 10 can be configured to perforate the well casing 12 of a predetermined thickness. A typical well casing 12 that can be perforated by the device 10 is formed of ½ inch thick steel plate. This regard, the length of the barrel portion of the passageway 40 can be about 6 inches. It should be appreciated that the actual length of the barrel portion of the passageways 40 can vary depends upon a variety of factors including the mass of the projectile, the amount of fuel use, and the amount of pressure generated.

During step D) the passageway 40 and the fuel rail 38 is cleared mechanically, by rapid movement of gases which carries physical debris out of the device 10 and the well casing 12. The fuel rail 38 can also be cleared thermally by heat generated during the discharge of the cartridge 20 such that material, such as physical debris, is degraded.

Figure 6:
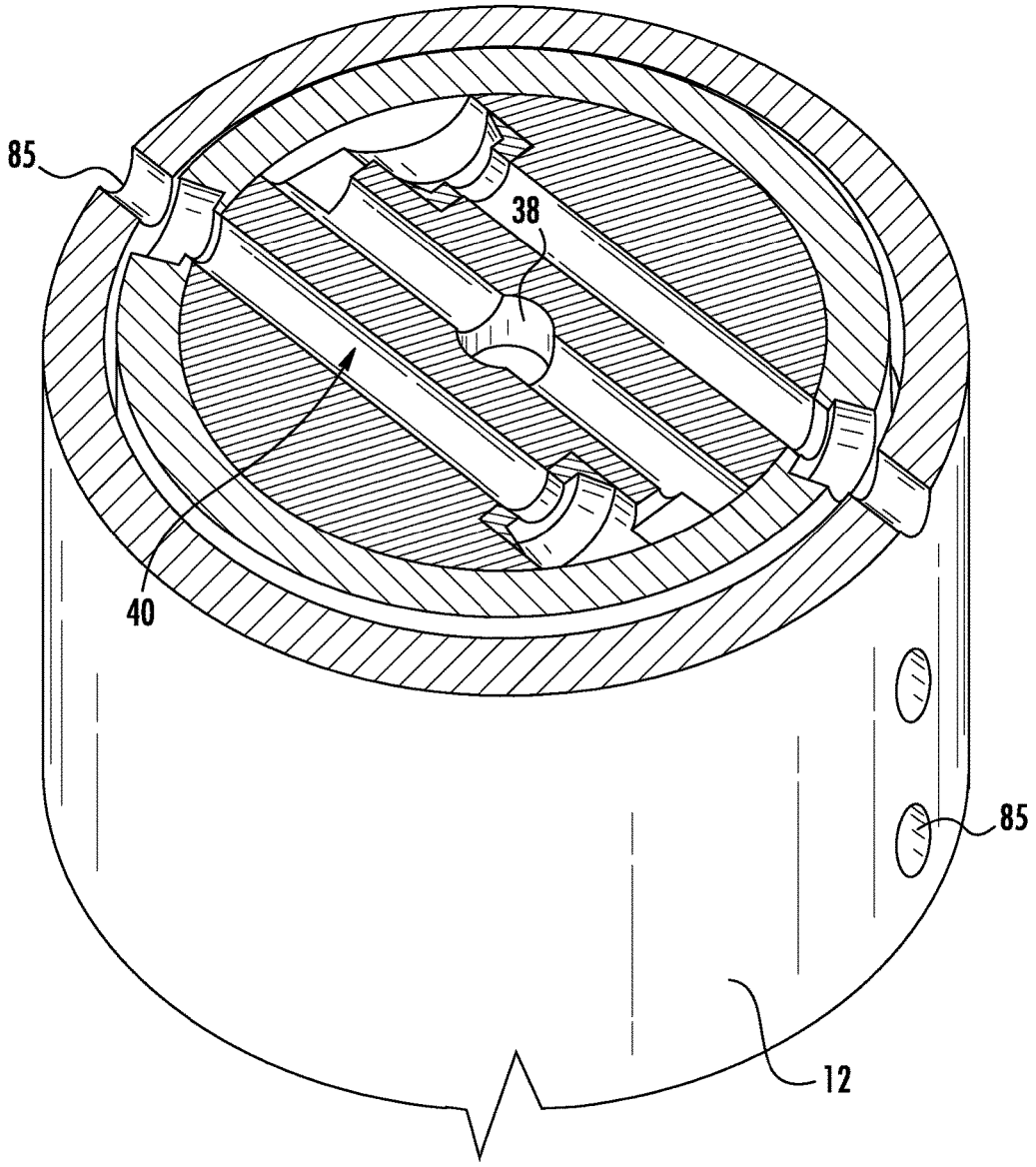
FIG. 6 is a perspective view of a section of the device in which it is in the second condition.

Referring now to FIG. 6, after the initiation of the cartridge 20 and its operation, the device 10 is in its second condition. The fuel rail 38 is fluidly connected to at least some of the passages 40. Thus the exterior surface of the well casing 12, and therefore the surrounding ground material such as rock, is fluidly connected through the passages 40, the fuel rail 38, and a casing path 85 to the surface via well 14. Ground resources such as hydrocarbons can be extracted along this path to the surface.

It should be appreciated that in embodiments in which the barrier 58 is essentially the thickness of the housing 32, perforation of the barrier 58, could deform the barrier 58 such that the device 10 would be wedged into the well casing 12. If the device 10 were wedged into the well casing 12, it might not be removable if desired. The pits 39 are configured such that waste material pushed outward by the projectile 70 as it is expelled through the end barrier 58 does not extend beyond the outer perimeter of the housing 32. Thus the device 10 is configured to be removed from the well if desired when it is in the second condition, i.e. after operation of the cartridge 20.

During the ignition and operation of the cartridge 20, pressures of up to about 100,000 pounds per square inch are generated. The duration of such pressures generated by the cartridge 20 is dependent upon the amount of fuel provided and the configuration of the cartridge 20. Therefore the duration of the pressure wave associated with operation of the device 10 can be as short as that generally associated with high explosives of about a millisecond. The duration can also be 10-30 seconds or longer.

Figure 7:
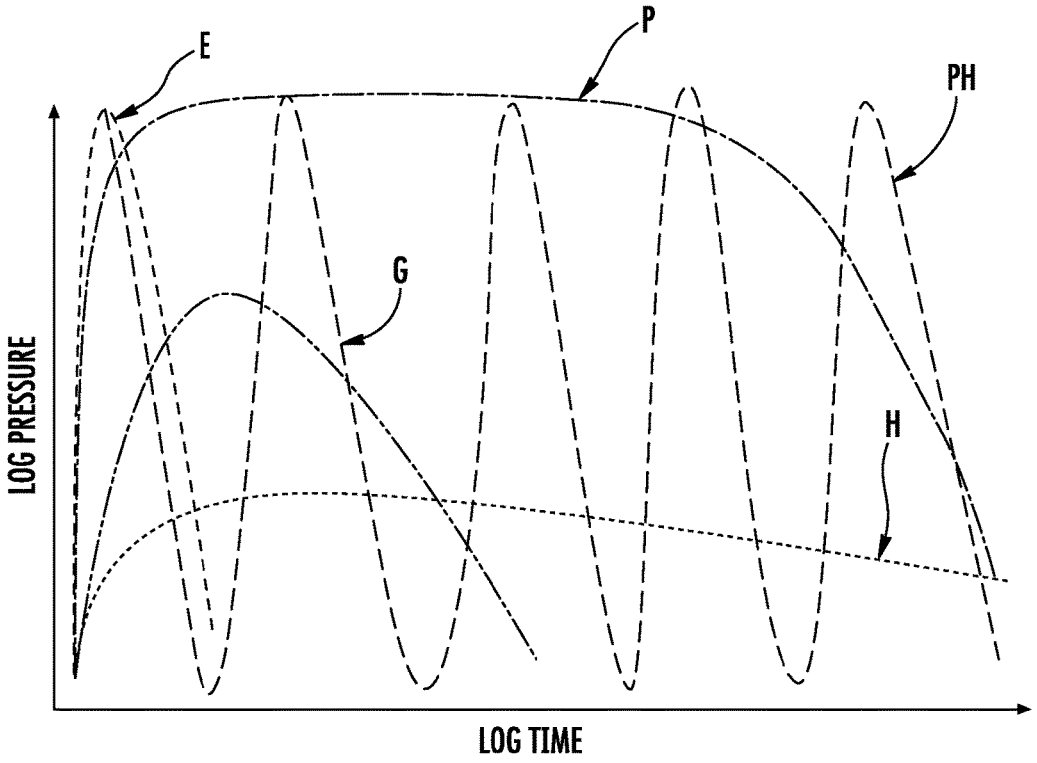
FIG. 7 is a chart showing pressure wave characteristics of prior art devices compared to those of the present invention.

In some embodiments, the cartridge 20 is configured to generate a succession of waves of shorter duration to create a hammering effect. The peak pressure of each of these successive waves can be up to about 100,000 psi. For comparison, high explosives generate about 1,000,000 psi but for only about 1 ms. FIG. 7 shows a comparison of the pressures and durations of the cartridge 20 compared to explosive E, gas gun G, and hydraulic H. A pressure wave P is generated by cartridge 20 according to the illustrated embodiment. Pressure wave PH represents pressure wave generated by a cartridge 20 in an alternative embodiment wherein a hammering effect is created.

The present invention provides several commercial advantages over conventional methods of perforating well casing. These advantages include the ability to perforate a well casing and fracture surrounding rock within one step. The advantages also includes the ability to leave the device in the well after the perforation and fracturing step. Another advantage is that surrounding rock is not compacted during the perforation step. Another advantage is that high explosives are not used with the disclosed device and therefore the dangers associated with transporting in using such high explosives is avoided. The device 10 may be connected to multiple sections to form long lengths of well casing perforating capability. The multiple sections can be initiated simultaneously or in a predetermined sequence.

The foregoing has described a system and method of perforating a well casing and fracturing surrounding rock. All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly conditioned otherwise. Thus, unless expressly conditioned otherwise, each feature disclosed is one example only of a generic series of equivalent or similar features.

The invention is not restricted to the details of the foregoing embodiment(s).The invention extends to any novel one, or any novel combination, of the features disclosed in this specification (including any accompanying claims, abstract and drawings), or to any novel one, or any novel combination, of the steps of any method or process so disclosed.

What is claimed is:

1. An apparatus for perforating a well casing, the apparatus comprising:

a body;

a cavity defined in the body;

a plurality of pressure paths that each include a first portion and a corresponding second portion defined in the body such that the body defines multiple first portions and each pressure path is fluidly connected to the cavity;

a seal positioned in each pressure path between the first portion and the second portion of that pressure path until the seal in each pressure path is exposed to a predetermined pressure;

the second portion of each pressure path defining a barrel that is configured to be fluidly connected to the cavity after the seal in each pressure path is exposed to a predetermined pressure;

a projectile positioned in each barrel; and wherein each barrel is blocked at an end opposite the projectile and the blockage is configured to be ruptured by the projectile.

2. The apparatus according to claim 1, wherein the cavity is configured to receive a high pressure fluid such that each path of the plurality of pressure paths is fluidly connected to a source of high pressure fluid.

3. The apparatus according to claim 2, wherein the cavity is configured to receive a source for high pressure fluid.

4. An apparatus for perforating a well casing, the apparatus comprising:

a body;

a cavity;

at least one pressure path defined in the body that is fluidly connected to the cavity;

a seal positioned in the pressure path until the seal is exposed to a predetermined pressure;

a barrel that is configured to be fluidly connected to the pressure path after the seal is exposed to a predetermined pressure;

a projectile positioned in the barrel; and wherein the barrel is blocked at an end opposite the projectile and the blockage is configured to be ruptured by the projectile and the cavity is configured to receive a high pressure fluid such that the at least one pressure path is fluidly connected to a source of high pressure fluid and wherein the seal is configured to rupture when the pressure path is fluidly connected to the source of high pressure fluid.

5. The apparatus according to claim 4, wherein the barrel is configured to provide for acceleration of the projectile such that the projectile can exit the barrel.

6. The apparatus according to claim 5, wherein the projectile can perforate a well casing positioned near the barrel.

7. A method for perforating a well casing and preparing a well for extraction of fluids from rock positioned near the well, the method comprising the steps of:

providing a device for perforating a well casing, the device comprising:

a body;

a cavity defined in the body;

a plurality of pressure paths that each include a first portion and a corresponding second portion defined in the body such that the body defines multiple first portions and each pressure path is fluidly connected to the cavity;

a seal positioned in each pressure path between the first portion and the second portion of that pressure path until the seal in each pressure path is exposed to a predetermined pressure;

the second portion of each pressure path defining a barrel that is configured to be fluidly connected to the cavity after the seal in each pressure path is exposed to a predetermined pressure;

a projectile positioned in each barrel; and wherein each barrel is blocked at an end opposite the projectile and the blockage is configured to be ruptured by the projectile;

positioning the device within a well casing;

filling the first portion of each passageway with a high pressure fluid;

expelling the projectile from the passageway;

puncturing the well casing with the projectile such that openings are formed therein; and clearing the passageway.

8. The method for perforating a well casing according to claim 7 further comprising the steps of:

expelling the projectile into rock position near the well casing;

creating pathways in the rock with the projectile; and expelling the high pressure fluid into the pathways in the rock such that the rock is further fractured.

9. The method for perforating a well casing according to claim 8 further comprising the step of:

allowing a second fluid to flow from the rock through the openings of the well casing into the passageway and into a conduit for extraction.

* * * * *